United States Patent [19]

Dantlgraber

[11] Patent Number: 4,634,354

[45] Date of Patent: Jan. 6, 1987

[54] HYDRAULIC PUMP

[75] Inventor: Jörg Dantlgraber, Lohr-Sackenbach, Fed. Rep. of Germany

[73] Assignee: Mannesmann Rexroth GmbH, Lohr, Fed. Rep. of Germany

[21] Appl. No.: 752,724

[22] Filed: Jul. 8, 1985

[30] Foreign Application Priority Data

Jul. 6, 1985 [DE] Fed. Rep. of Germany ..... 3425013

[51] Int. Cl.[4] ..... F04C 2/00

[52] U.S. Cl. ..... 418/31; 418/270

[58] Field of Search ..... 418/24, 27, 30, 31, 418/259, 266–270

[56] References Cited

U.S. PATENT DOCUMENTS

| | | | |
|---|---|---|---|
| 3,252,423 | 5/1966 | Whitmore | 418/27 |
| 3,527,552 | 9/1970 | Lincks | 418/24 |
| 3,717,423 | 2/1973 | Pedersen | 418/24 |

*Primary Examiner*—Carlton R. Croyle

*Assistant Examiner*—Jane E. Obee

*Attorney, Agent, or Firm*—Cushman, Darby & Cushman

[57] ABSTRACT

A hydraulic pump of the type in which a cam ring and rotor are mounted within a rotor chamber formed between a cover and housing fixedly mounted together. An adjustment screw extends into the rotor chamber transverse to the axis of rotation for adjusting the level of the cam ring. Two pairs of bolts, and only two pairs, extend parallel to the rotation axis at a given radius from that axis to fix together the housing and cover. The distance between the pair of bolts on either side of the adjustment screw and at the pressure region are less than the distance betwen the bolts of the opposite pair at the suction region. Further the angle $\beta$ between an x-x axis transverse to both the adjustment axis and the rotation axis and the radii of the pair of bolts on either side of the adjustment screw is between 60° and 75° and the angly $\gamma$ between the x-x axis and the radii of the other pair of bolts is between 25° and 40° so that each bolt takes up approximately the same amount of force.

5 Claims, 5 Drawing Figures

HYDRAULIC PUMP

The invention relates to hydraulic pumps. Especially the invention relates to a hydraulic rotary vane-type pump comprising a housing, a cover, fixedly mounted to said housing, said housing and said cover defining a rotor chamber communicating with a pump inlet and a pump outlet, bearing means in said housing and said cover, a rotor journaled in said bearing means and confined in said chamber between the side-walls thereof, the rotor having vanes slidably projecting from its periphery, a cam ring which encircles the rotor and is shiftable towards and from concentricity with the rotor and coacts with the vanes to provide pumping chambers by which fluid is taken from the inlet pressurized and delivered to the outlet, said pumping chambers defining in said chamber a suction region in the vicinity of the inlet and a pressure region in the vicinity of the outlet, four threaded bolt means adapted to be inserted into appropriate bores of the cover and into threaded bores provided in the surface of said housing, so as to fixedly mount said cover to said housing.

A variable volume pump of the type to which the invention pertains in particular is a rotaty vane-type pump disclosed in U.S. Pat. No. 3,272,138. Similarly, West-German Offenlegungsschrift DE-OS No. 32 42 983 shows a rotary vane-type pump.

Said known pumps, specifically said known rotary vane-type pumps are subject to forces which are created by the pressure of the pressure medium. The components of the known pumps are subject to unequal stress caused by said forces. Especially, the threaded bolts are subject to unequal loads. One pair of said threaded bolts is subject to a high load created by said forces, while the other pair of threaded bolts is subject to a substantially lower load caused by said forces. This is inherently disadvantageous. Particularly in view of the fact that the pump housing is already subject to different loads acting in radial direction. The more space there is between the threaded bolts which are located in the region of high pressure, the more increases the possibility that the pump housing is deformed.

Inasmuch as the pumps to which the invention relates are manufactured in large numbers, it is of great importance to provide for a low cost manufacture. p It is an object of the present invention to provide a hydraulic pump such that the mounting means which are used for securing the cover to the housing, mounting means which preferably are in the form of threaded bolts, are subjected to equal forces or the same amount of load. Another object of the invention is to provide a pump where the load applied to the pump housing as well as to the cover is equalized, i.e. more evenly distributed.

In accordance with the invention a hydraulic pump comprises a housing, a cover, and mounting means for fixedly mounting said cover to said housing, wherein the housing and the cover are formed such that said mounting means are subject to substantially the same amount of force. Preferably, said mounting means are threaded bolts. Preferably four threaded bolts are used to fixedly mount said cover on said housing.

With the above and other objects in view which will appear as the description proceeds, this invention resides in the novel construction, combination and arrangement of parts substantially as hereinafter described and more particularly defined by the appended claims, it being understood that such changes in the prescribed embodiments of the herein disclosed invention may be made as come within the scope of the claims.

The accompanying drawings illustrate an example of the prior art and one embodiment of the invention contructed according to the best mode, so far devised for practical application of the principles thereof, and in which FIG. 1 is an axial cross-sectional view of a rotary vane-type pump to which the invention specifically relates;

Figure 1:
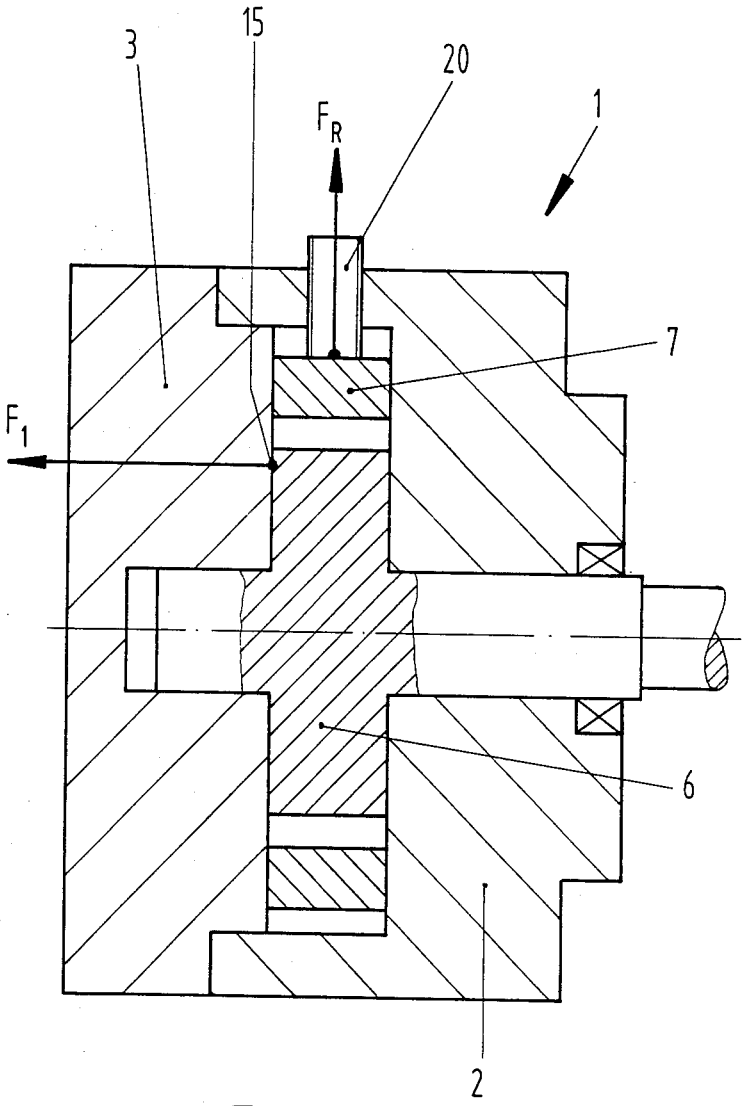
FIG. 1 (PRIOR ART)

FIG. 1 shows in a longitudinal cross-sectional view of a rotary vane-type pump 1. The vane-type pump 1 comprises in substance a housing 2 within which a rotor 6 is provided. The housing 2 is closed by means of a cover 3. The rotor 6 is surrounded by a cam or pressure ring 7. Adjustment screw means 20 serve for the adjustment of the level or height of the cam ring 7. The level adjustment screw 20 is subjected to the force $F_R$ acting in radial direction (radial force $F_R$). Most of the other components of the pump, like a port plate, inlet, outlet etc. are not shown. Such components are well known and not related to the invention.

A pump of this type is shown in U.S. Pat. No. 3,272,138 and also in German Offenlegungsschrift DE-OS No. 32 42 983.

Figure 2:
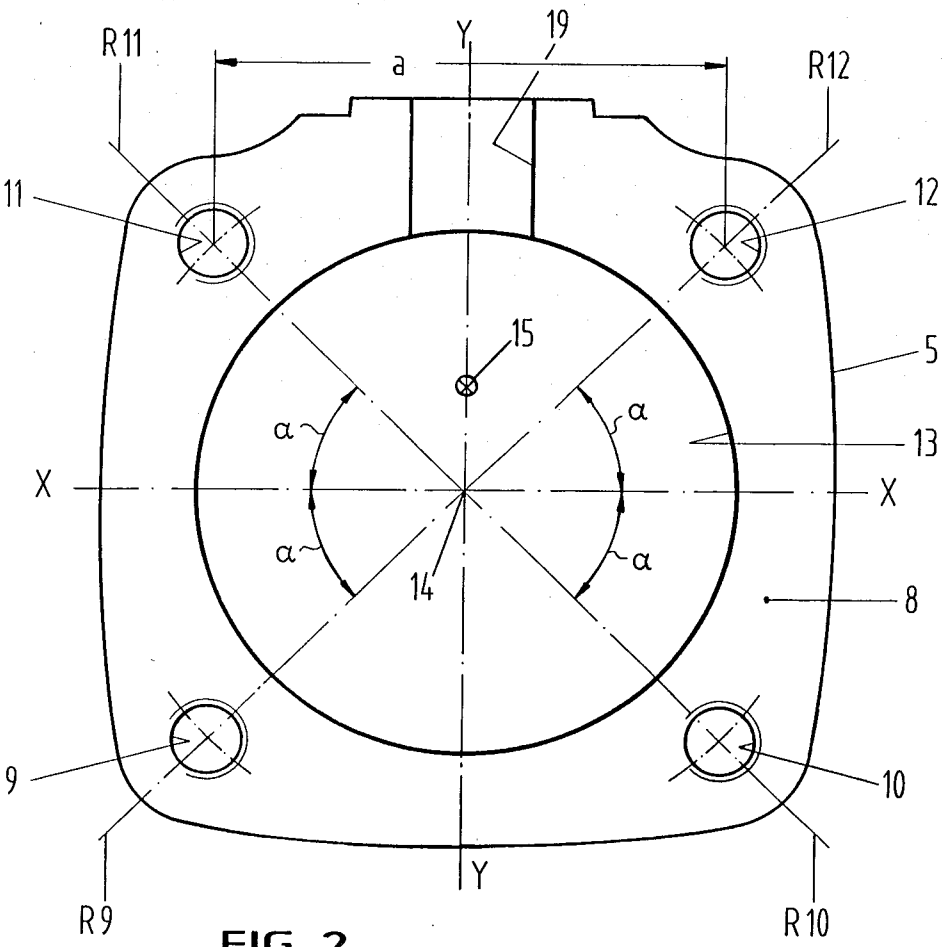
FIG. 2 is a schematic top plan view of the surface of a housing of a rotary vane-type pump of the prior art.

FIG. 2 discloses a top plan view of the surface 8 of a housing 2 of a prior art pump of the type shown in FIG. 1. Threaded bores 9 to 12 are shown in the upper surface 8. Said threaded bores 9 to 12 extend into the housing 1, i.e. into the plane of the paper. The centers of the bores 9 and 10 as well as the centers of the bores 11 and 12 lie on the appropriate radii R 9, R 10 and R 11, R 12, respsectively. Said radii (radial lines) form an angle of 2 $\alpha$ inbetween. Each of said radii or radial lines forms together with the appropriate axes X—X and Y—Y an angle $\alpha$. An opening 19 (which is preferably provided with thread means) in housing 2 receives the level adjustment screw 20 which is shown in FIG. 1 but not in FIG. 2. The level adjustment screw cooperates with the cam ring 7 which is not shown in FIG. 2.

For the pump shown in FIGS. 1 and 2 the assumption is made that only one pressure region and one suction region is provided. The pressure region is arranged approximately in an area defined by the radii R 11 and R 12. The suction region is arranged in a mirror-like fashion with respect to the X—X axis and is consequently located between the radii R 9 and R 10.

Figure 3:
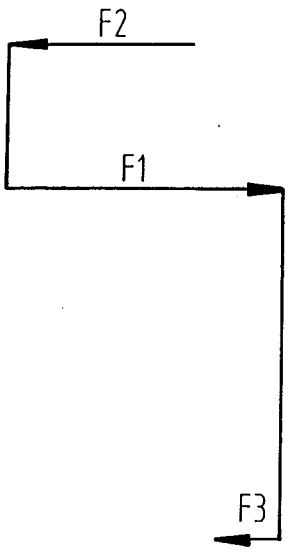
FIG. 3 shows a vector diagram of the forces occurring in a prior art housing of FIG. 2.

The pressure medium generates in the pressure region or space a force F1 which acts against the cover 3. Said force F1 (which is the resultant of the distributed pressure force) can be thought to be acting in a single center of pressure shown at 15. The force F1 is opposed by forces F2 and F2 as is shown in FIG. 3. The force F2 has to be taken-up by threaded bolts (not shown), threaded bolts which are screwed into threaded bores 11 and 12. The force F3 has to be taken-up by threaded bolts which are screwed into threaded bores 9 and 10. The vector diagram represents this situation. It can be seen that the threaded bolts screwed into the threaded bores 9 and 10 are required to receive a significantly smaller force F3, smaller than the force F2 which has to be taken-up by the threaded bolts screwed into the threaded bores 11 and 12.

It should also be noted that a pump having a housing of the type shown in FIG. 2 together with a correspondingly designed cover has an advantage insofar as there is less material and less manufacturing time required in comparison to round pumps or pumps having a plurality of corner portions, situations where 6 or more bolts are necessary to provide for the axial connection between the cover and the housing. This advantage which is present for the pump of FIG. 2 is, however, somewhat lessened due to the mentioned fact that the threaded bolts are subject to unequal forces.

An additional disadvantage of the pump design shown in FIG. 2 is due to the fact that the threaded bolts placed in the threaded bores 11 and 12 are spaced with a relatively large distance, a situation which leads to a relatively large axial deformation of the cover 3. The consequence of the axial deformation is a low volumetric efficiency and a high noise level.

The great distance of the threaded bores 11 and 12, and also the force $F_R$ received by the level adjustment screw 20 lead to a heavy deformation of the housing 2 in the direction of the axis Y—Y (i.e. in upward direction in FIG. 2).

Figure 4:
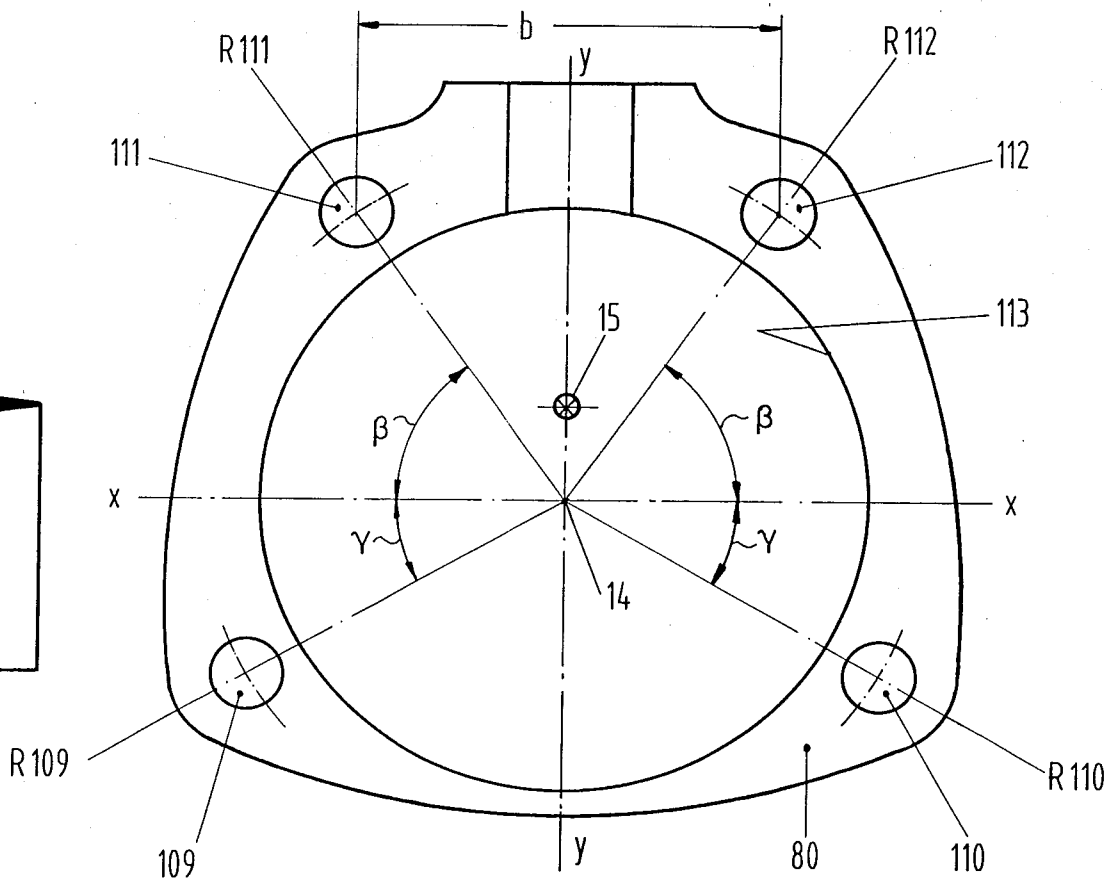
FIG. 4 is a top plan view of the upper surface of a pump housing designed according to the invention.
Figure 5:
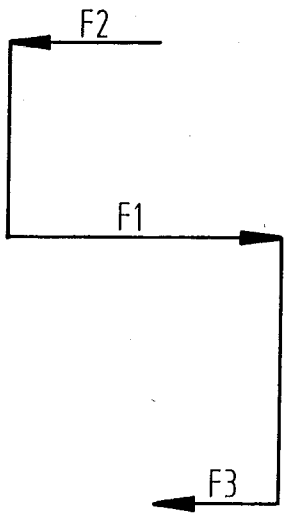
FIG. 5 is a vector diagram of the forces occurring in a housing of FIG. 4 designed in accordance with the invention.

FIG. 4 discloses a pump designed according to the invention, i.e. FIG. 4 shows schematically the upper surface of the housing of said pump. Similarly to what is shown in FIG. 2 again in the representative of FIG. 5 the force F1 can be considered to be acting at the center of pressure point 15. This force F1 is opposed by forces F2 and F3. The force F2 is provied by the threaded bolts arranged in the threaded bores 111, 112, and the force F3 is provided by the threaded bolts arranged in threaded bores 109 and 110. It is seen that the force F2 in FIG. 5 is now smaller than the force F2 in FIG. 3, i.e. due to the design of the housing shown in FIG. 4 the force F1 is distributed more evenly to the threaded bolts.

In accordance with the inventention the bending of the cover is reduced and the volumetric efficiency is improved and further a reduction of the noise emission of the pump is achieved by arranging the threaded bores in the housing as well as in the cover in such a manner that all the threaded bolts which are inserted in said threaded bores will take up approximately the same amount of force, and the threaded bolts 11 and 12 which are in the area of the pressure region will be placed with a distance which is as small as possible.

Preferably four threaded bores 109, 110, 111, 112 are provided in the housing; said bores can be aligned with bores in the cover 3, whereupon four bolts are screwed into said four bores 109–112.

In accordance with the teachings of the invention the upper pair of threaded bolts or the threaded bores 111, 112 in which said threaded bolts are placed will now be arranged with a distance b. The distance "b" is smaller than the distance "a" of the pair of threaded bores 11, 12 (see FIG. 2). Also, in accordance with the invention the distance of the threaded bores 109 and 110 as shown in FIG. 4 is larger than the distance of the threaded bores 9, 10 in FIG. 2.

The housing shown in FIG. 2 shows an angle $\alpha$ between the axis X—X and the radii R 11 and R 12, respectively. In accordance with the invention represented by FIG. 4 the angle between the axis X—X and R 111 and R 112, respectively, is $\beta$ with $\beta$ being larger than $\alpha$. Further, for the housing of FIG. 4 the angle between axis X—X and R 109 and radius R 110, respectively is now $\gamma$, with $\gamma$ being smaller than $\alpha$.

Inasmuch as $\alpha$ is 45° in the prior art, the design of the invention is defined as follows: $\beta$ is larger than $\alpha$ and $\gamma$ is smaller than $\alpha$.

In accordance with the invention $\beta$ is preferrably in a range between about 60° to about 75°, or about 60° to about 70°. $\gamma$ is preferrably in a range of 25° to 40°. The distance of the centers of the threaded bores 109 to 112 with respect to the inner surface 113 of the housing 2 is not changed and is the same for all the bores 109–112.

By moving the threaded bolts placed in the threaded bores 111, 112 practically closer together, the supporting part of the housing which extends between the two threaded bores 111, 112 is subject to a lower load in radial direction. Moreover, the threaded bolts which are now placed closer to each other in the appropriate thread bores 111, 112 will avoid a deformation of the cover 3 in the axial direction of the rotor shaft. As a consequence, the oscillating amplitudes acting in axial and radial directions and created by the forces due to the change of pressure will be reduced. Both situations have the mentioned consequence of a reduced emission of noise.

The invention is preferrably used for rotary vane-type pumps, but can also be used by other hydraulic single-pole pumps. The invention relates preferrably to a pump housing to which a cover is fixedly mounted by means of four threaded bolts. It is, however, also conceivable that a different number of threaded bolts is used.

The invention may also be used for a pump in which the housing 2 comprises two housing members, one surrounding the rotor and the other surrounding the rotor shaft which extends out of the pump.

I claim:

1. A hydraulic pump comprising:

a housing;

a cover fixedly mounted to said housing to define a rotor chamber;

a rotor mounted in said rotor chamber for rotation about an axis;

a cam ring mounted in said rotor chamber;

adjustment means for applying forces through said housing along an adjustment axis transverse to said rotation axis to adjust the level of said cam ring;

said rotor chamber defining a single pressure region and a single suction region, said regions being arranged in a mirror-like fashion with respect to an x-x-axis transverse to said adjustment axis;

means for mounting said cover to said housing including two and only two pairs of bolts extending parallel to said rotation axis, one of said pairs of bolts being arranged in the area of said pressure region while the other pair of bolts being arranged in the area of the suction region, wherein the angular distance of said one pair of bolts is less than 90°, and the angular distance of said other pair of bolts is larger than 90°.

2. A pump as in claim 1 wherein the angular distance between said one pair of bolts is in a range of approximately 40 to approximately 60 degrees, while the angular distance between said other pair of bolts is in the range of approximately 100 to 130 degrees.

3. A pump as in claim 2 wherein said angular distance between said one pair of bolts is in the range of approximately 30 to 60 degrees.

4. A hydraulic pump comprising:

a housing;

a cover fixedly mounted to said housing to define a rotor chamber with a single pressure region and a single suction region;

a rotor mounted in said rotor chamber for rotation about an axis;

a cam ring mounted in said rotor chamber;

adjustment means for applying forces through said housing along an adjustment axis transverse to said rotation axis to adjust the level of said cam ring said regions being arranged in mirror-like fasion with respect to an x-x axis transverse to said adjustment axis;

means for mounting said cover to said housing including two and only two pairs of bolts extending parallel to said rotation axis at a given radius from said rotation axis, the distance between the bolts of the pair of bolts on either side of the location where said forces are applied being less than the distance between the bolts of the other pair and the angle $\beta$ between an x-x axis transverse to said adjustment axis and said rotation axis and the radii of said pair of bolts on either side of said adjustment means is between 60° and 75° and the angle $\gamma$ between said x-x axis and the radii of said other pair of bolts is between 25° and 40° so that each bolt takes up approximately the same amount of force.

5. A pump as in claim 4 wherein said bolts on either side of said adjusting means is in the area of the pressure region and said other pair of bolts are in the area of the suction region.

* * * * *